US007661458B2

(12) United States Patent
Haga et al.

(10) Patent No.: US 7,661,458 B2
(45) Date of Patent: Feb. 16, 2010

(54) METHOD AND APPARATUS FOR PRODUCING THIN MAGNESIUM BASED ALLOY PLATE

(75) Inventors: Toshio Haga, Oosaka (JP); Kazunari Yoshida, Kanagawa (JP); Yoshio Gonda, Tokyo (JP)

(73) Assignee: Gonda Metal Industry Corporation Ltd., Sagamihara-shi (JP)

( * ) Notice: Subject to any disclaimer, the term of this patent is extended or adjusted under 35 U.S.C. 154(b) by 0 days.

(21) Appl. No.: 10/548,172

(22) PCT Filed: Mar. 1, 2004

(86) PCT No.: PCT/JP2004/002489

§ 371 (c)(1),
(2), (4) Date: Sep. 11, 2007

(87) PCT Pub. No.: WO2004/078381

PCT Pub. Date: Sep. 16, 2004

(65) Prior Publication Data

US 2006/0225862 A1 Oct. 12, 2006

(30) Foreign Application Priority Data

Mar. 7, 2003 (JP) ..... 2003-060801
Jul. 28, 2003 (JP) ..... 2003-280796

(51) Int. Cl.
*B22D 11/06* (2006.01)

(52) U.S. Cl. ..... 164/480; 164/481; 164/900

(58) Field of Classification Search ..... 164/480, 164/481, 428, 432, 900
See application file for complete search history.

(56) References Cited

U.S. PATENT DOCUMENTS 4,911,226 A * 3/1990 Cleary et al. ..... 164/478

(Continued)

FOREIGN PATENT DOCUMENTS

CA 2 438 720 A1 10/2002

(Continued)

OTHER PUBLICATIONS

Toshio Haga, "Semisolid Strip casting using a twin roll caster equipped with a cooling slope", Journal of Materials Processing Technology, vol. 130-131, XP-002364828, Dec. 20, 2002, pp. 558-561.

*Primary Examiner*—Kevin Kerns
*Assistant Examiner*—Ing-Hour Lin
(74) *Attorney, Agent, or Firm*—Oblon, Spivak, McClelland, Maier & Neustadt, P.C.

(57) ABSTRACT

A magnesium metal thin plate manufacturing method includes at least a casting process of supplying a molten metal obtained by melting a magnesium metal to a molten metal bath, drawing out the molten metal, supplying the molten metal into the gap between a pair of casting rolls composed of at least a pair of casting upper roll and casting lower roll, applying pressure to the molten metal, and casting a plate solidified at a predetermined temperature and having a predetermined thickness, and a rolling process of rolling the cast plate by means of at least a pair of rolling rolls by applying pressure thereto to manufacture a magnesium metal thin plate. With the above arrangement, there can be provided a magnesium metal thin plate manufacturing method and manufacturing apparatus that can effectively manufacture a magnesium metal thin plate by plastic working without requiring a heat energy generation step again in rolling.

2 Claims, 5 Drawing Sheets

U.S. PATENT DOCUMENTS

| | | | | |
|---|---|---|---|---|
| 5,501,748 | A * | 3/1996 | Gjestland et al. | 148/538 |
| 2002/0134471 | A1 * | 9/2002 | Motegi et al. | 148/538 |
| 2003/0205357 | A1 * | 11/2003 | Unal | 164/480 |
| 2004/0084173 | A1 | 5/2004 | Nishikawa et al. | 164/482 |

FOREIGN PATENT DOCUMENTS

| | | | |
|---|---|---|---|
| JP | 2000-212607 | | 8/2000 |
| JP | 2001-252759 | | 9/2001 |
| JP | 2002-283007 | | 10/2002 |
| JP | 2003-340552 | | 12/2003 |
| WO | WO 02/083341 | A1 | 10/2002 |

* cited by examiner

METHOD AND APPARATUS FOR PRODUCING THIN MAGNESIUM BASED ALLOY PLATE

CROSS-REFERENCE TO RELATED APPLICATIONS

This application is based upon and claims the benefit of priority from the prior Japanese Patent Application No. JP2003-060801, filed on Mar. 7, 2003 and Japanese Patent Application No. JP2003-280796, filed on Jul. 28, 2003, the entire contents of each of which are herein incorporated by reference.

TECHNICAL FIELD

The present invention relates to a magnesium or magnesium alloy thin plate manufacturing method and manufacturing apparatus, and to a magnesium or magnesium alloy thin plate manufacturing method and manufacturing apparatus for manufacturing a magnesium or magnesium alloy thin plate by casting and then rolling magnesium or magnesium alloy.

BACKGROUND ART

Since magnesium is rich in resources among metals and has a weight less than that of aluminum and iron, attention is paid to the application thereof to light-weight parts. Although the actual strength of magnesium is inferior to that of aluminum and iron, it has high specific strength because it is light in weight, and thus it can be used in place of aluminum when the same strength is required. Accordingly, it is expected to apply magnesium to products such as a caring and welfare apparatus and the like the reduction of weight of which is required.

Further, magnesium has such excellent characteristics that it can prevent electromagnetic noise of electronic equipment because it is excellent in an electromagnet shielding property, has a superior capability for absorbing oscillation, and can reduce noise.

Moreover, magnesium has excellent resistivity against deformation and impact, whereas it can be machined easily. In addition to the above-mentioned, since magnesium has a low melting point and is excellent in a recycle property, it has superior characteristics in that it is a metal suitable for the environmental protection of the earth.

Incidentally, heretofore, magnesium metal products are manufactured by die casting and thixotropic molding (injection molding), and it is difficult to effectively manufacture the products by plastic working. Accordingly, magnesium cannot be molded without using a casting mold, and thus it is applied only to limited products. That is, at present, magnesium cannot establish a presence in the market in the application thereof to products for various uses made by plastic working because a technology for effectively manufacturing a magnesium metal thin plate has not been established.

Further, in the manufacture of the magnesium metal products described above, a lot of unnecessary products such as runner channels and the like are made in the process of molding magnesium in a metal mold, from which problems arise in that the yields of materials are deteriorated and gas pockets are formed in molded magnesium products by gas bubbles involved therein.

To cope with the above problems, Japanese Patent Application Laid-Open No. 2001-294966 discloses a method of manufacturing a magnesium metal thin plate that can be easily molded by manufacturing a magnesium metal sheet by a die cast method and then rolling the metal plate.

When the magnesium metal plate member is rolled as described above, voids, which were present inside of the plate member when it was cast, will be crushed and reduced in size or disappear. As a result, a magnesium metal thin plate without gas pockets therein can be obtained.

However, in the method disclosed in Japanese Patent Application Laid-Open No. 2001-294966, after the magnesium metal plate member is manufactured by the die cast method, it must be subjected to a trimming process once when it is rolled, and thus the plate member is rolled at room temperature.

That is, since the magnesium metal plate member is rolled at room temperature, it is pressed and deformed in a thickness direction by a rolling mill at such a draft as not to break the plate member. Since it means that the plate member cannot be deformed to a desired thickness that the draft is limited as described above, it cannot be said that the above method is excellent in productivity.

As a method of solving the above problem, it is also contemplated to hot-roll or to hot-extrude the plate member to deform it. However, an enormous amount of heat energy is consumed to execute the hot rolling or hot extrusion, from which a technical problem arises in that productivity is bad.

As means for solving the above problem, there is known a method of forming a continuous plate-shaped raw metal material through a continuous process by forming a metal slurry, which has a thixotropic property and contains a solid phase, by cooling magnesium molten metal and then further cooling and rolling the metal slurry (refer to Japanese Patent Application Laid-Open No. 2002-283007). In the method, however, since the magnesium molten metal is cooled to such a degree as to provide it with the thixotropic property and then supplied into a pair of rolls and cast thereby, the ratio of the solid phase in the molten metal supplied to the pair of casting rolls is high (20% or more, and a typical thixotropic property is ordinarily exhibited at about 50%). Since the magnesium molten metal, in which the solid phase and a liquid phase coexist as described above, has high viscosity, the molten metal is liable to be solidified in a nozzle for supplying it to the pair of casting rolls, and thus there is a large possibility that the nozzle is clogged by the molten metal. Accordingly, this method also has a technical problem in that yields in production are low and productivity is bad.

DISCLOSURE OF INVENTION

The present invention has been made in view of the above circumstances, and an object of the invention is to provide a magnesium or magnesium alloy thin plate manufacturing method and manufacturing apparatus that can effectively manufacture a magnesium or magnesium alloy thin plate by plastic working without requiring a heat energy generation process again in rolling by continuously executing casting and rolling and that is excellent in productivity. It is also an object of the present invention to provide manufacturing means capable of flexibly coping with a varying schedule of production volume by discontinuously providing a casting process and a rolling process.

To solve the above problems, the magnesium or magnesium alloy (in the following explanation, magnesium and magnesium alloy are called magnesium metal as the generic name thereof) thin plate manufacturing method according to the present invention is a method of manufacturing a magnesium metal thin plate by casting a magnesium molten metal to a plate member by means of a pair of rolls and subsequently rolling the plate member. The manufacturing method is characterized by including at least a casting process of supplying the magnesium molten metal between at least a pair of rolls and casting the molten metal to a plate member having a predetermined thickness and solidified at a predetermined temperature, and a rolling process of rolling the cast plate member by applying pressure thereto by means of at least a pair of rolls to manufacture a magnesium metal thin plate having a predetermined thickness.

According to the present invention arranged as described above, since the magnesium metal plate member has a temperature suitable for rolling in the rolling process, it is possible to deform the plate member to the thin plate by applying pressure thereto at a desired draft without concern for breakage. That is, since the heat used to form the plate member in the casting process is utilized, it is not necessary to produce heat energy for rolling again, which permits the effective production of the magnesium metal thin plate.

Further, the magnesium metal thin plate manufacturing method is characterized in that the magnesium molten metal just before it enters the casting process is within the temperature range from a temperature at which the ratio of a solid phase occupying the magnesium metal is 10 wt % or less to a temperature 40° C. higher than the melting temperature of the magnesium metal. Furthermore, the magnesium metal thin plate manufacturing method is characterized in that a magnesium metal solid/liquid mixture is rapidly cooled at a speed of $5\times10^{2}$° C./sec or more before or after the casting process. With the above operation, the molten metal is prevented from being solidified at a molten metal drawing-out port as well as the fact that a plate member having a uniform metal structure can thus be manufactured.

Moreover, to solve the above problems, a magnesium metal thin plate manufacturing apparatus according to the present invention is a magnesium metal thin plate manufacturing apparatus for manufacturing a magnesium metal thin plate by melting a magnesium metal and then rolling it. The magnesium metal thin plate manufacturing apparatus is characterized by including at least a molten metal bath for storing a molten metal obtained by melting a magnesium metal, a casting roll section for casting a plate member solidified at a predetermined temperature by drawing out the molten metal from the molten metal bath and applying pressure to molten metal by means of at least a pair of rolls, and a rolling roll section for rolling the cast plate member by applying pressure to the plate member by means of at least a pair of rolls to manufacture a magnesium metal thin plate having a predetermined thickness.

With the above arrangement, since the magnesium metal plate member used in the rolling roll section has a temperature suitable for rolling similarly to the magnesium metal thin plate manufacturing method described above, it is possible to deform the plate member to a thin plate by applying pressure thereto at a desired draft without concern for breakage. That is, since the heat used in casting to form the plate member is utilized, it is not necessary to produce heat energy for rolling again, which permits the effective production of the magnesium metal thin plate.

Further, it is preferable that the casting roll section include at least a casting lower roll for causing the molten metal stored in the molten metal bath to solidify and to adhere around the roll surface thereof and drawing out the molten metal to the outside of the molten metal bath by the rotational force thereof, a casting upper roll for molding the molten metal drawn out to the outside of the molten metal bath by pressing the solidified surface thereof downward by means of the casting lower roll, and a rotational drive unit for rotating each of the casting lower roll and the casting upper roll and that the temperature of the roll surfaces of the casting lower roll and the casting upper roll can be adjusted, and the gap between the casting lower roll and the casting upper roll can be changed. With the above arrangement, a temperature and a thickness that are suitable for rolling can be freely set to a plate member to be cast, thereby the plate member can be effectively formed.

In addition, it is preferable in the magnesium metal thin plate manufacturing apparatus that the angle between an imaginary line connecting the rotating shaft of the casting lower roll and the rotating shaft of the casting upper roll and a vertical line (the angle is called a roll angle $\alpha$) be adjusted. When the angle $\alpha$ departs from a predetermined range, the magnesium metal plate member having been cast is liable to be exfoliated or broken because stress remains in the metal structure of the plate member, thereby productivity is deteriorated. Further, when various magnesium metals having a different composition or a different thickness are applied, optimum conditions for them can be easily set by permitting the angle between the pair of rolls to be adjusted, by which an apparatus excellent in workability can be realized.

BEST MODE FOR CARRYING OUT THE INVENTION

A magnesium metal thin plate manufacturing method and manufacturing apparatus according to the present invention will be explained below based on an embodiment shown in FIG. 1.

[Manufacturing Apparatus of First Embodiment]

Figure 1:
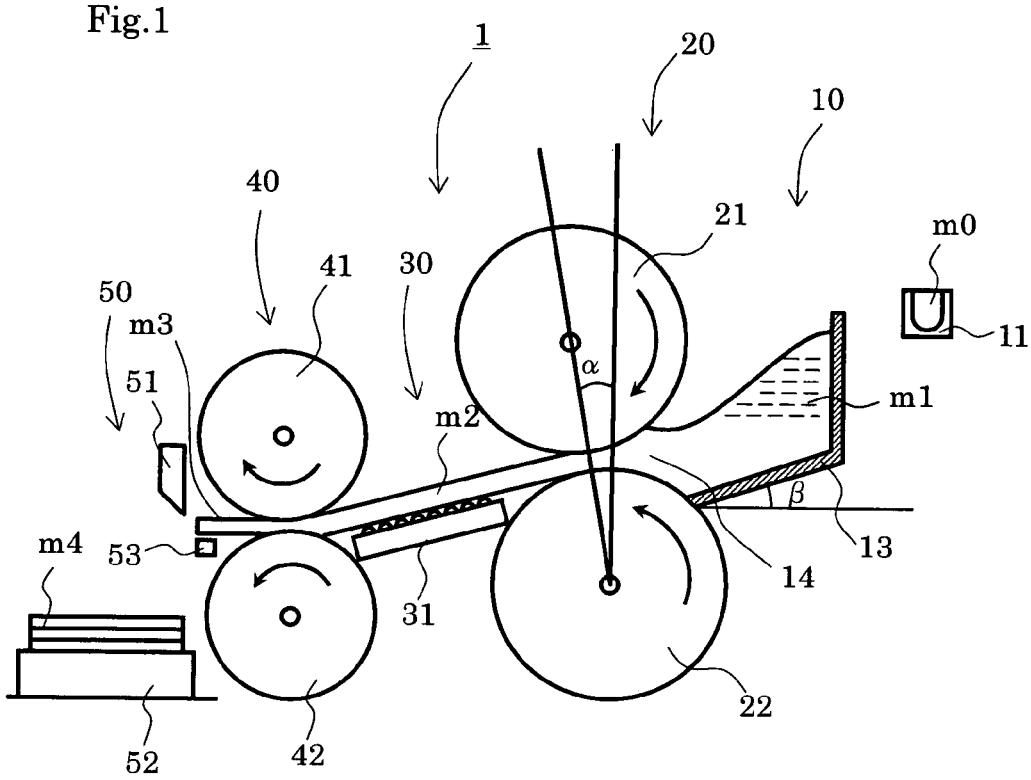
FIG. 1 is a schematic sectional view showing the overall arrangement of a magnesium metal thin plate manufacturing apparatus.

FIG. 1 is a schematic side elevational view showing the overall arrangement of a magnesium metal thin plate manufacturing apparatus of an embodiment of the present invention.

Reference numeral 1 in FIG. 1 denotes the magnesium metal thin plate manufacturing apparatus. The magnesium metal thin plate manufacturing apparatus 1 is approximately composed of a molten metal supply section 10, a casting roll section 20, a plate member conveying section 30, a rolling roll section 40, and a working section 50.

(Molten Metal Supply Section)

The molten metal supply section 10 is a mechanism for supplying a magnesium metal melted in a melting device (not shown) to the casting roll section 20 composed of a pair of rolls for casting the magnesium metal in the magnesium metal thin plate manufacturing apparatus 1, and the molten metal supply section 10 is composed of a crucible 11 and a molten metal bath 13.

The crucible 11 stores and accommodates a molten metal m0 composed of the magnesium metal in a molten state so as to maintain the temperature thereof and is arranged to introduce the molten metal m0 into the molten metal bath 13.

Further, the molten metal bath 13 is used to store a molten metal m1 and arranged such that the molten metal m1 is drawn out by the casting roll section 20 from a drawing-out port 13*a* formed on one side of the molten metal bath 13.

Although the bottom of the molten metal bath 13 may be in parallel with a horizontal surface, it is preferable that the bottom thereof be inclined at a predetermined angle with respect to the horizontal surface. In FIG. 1, the angle β between the bottom of the molten metal bath 13 and the horizontal surface may be set to 0 to 45°. The angle is more preferably 5 to 30°. A plate member can be stably cast without causing abnormality such as a ripple mark and the like on the surface of the plate member by setting the angle between the bottom of the molten metal bath 13 and the horizontal surface within the above range.

(Casting Roll Section)

The casting roll section 20 is a mechanism for casting the magnesium molten metal, which is supplied from an upstream process, between the pair of rolls at a predetermined temperature. That is, as shown in FIG. 1, the casting roll section 20 applies upward and downward pressure to the molten metal m1 and molds it to a plate member m2 having a predetermined thickness and temperature that permit the plate member m2 to be rolled. The casting roll section 20 is composed of at least a pair of rolls, i.e. a casting upper roll 21 and a casting lower roll 22 in a rotating operation state for casting the molten metal m1 drawn out from the drawing-out port 13*a* of the molten metal bath 13.

The arrangement of the casting roll section 20 that is a main portion of the magnesium metal thin plate manufacturing apparatus 1 will be explained in detail using FIG. 4.

Figure 4:
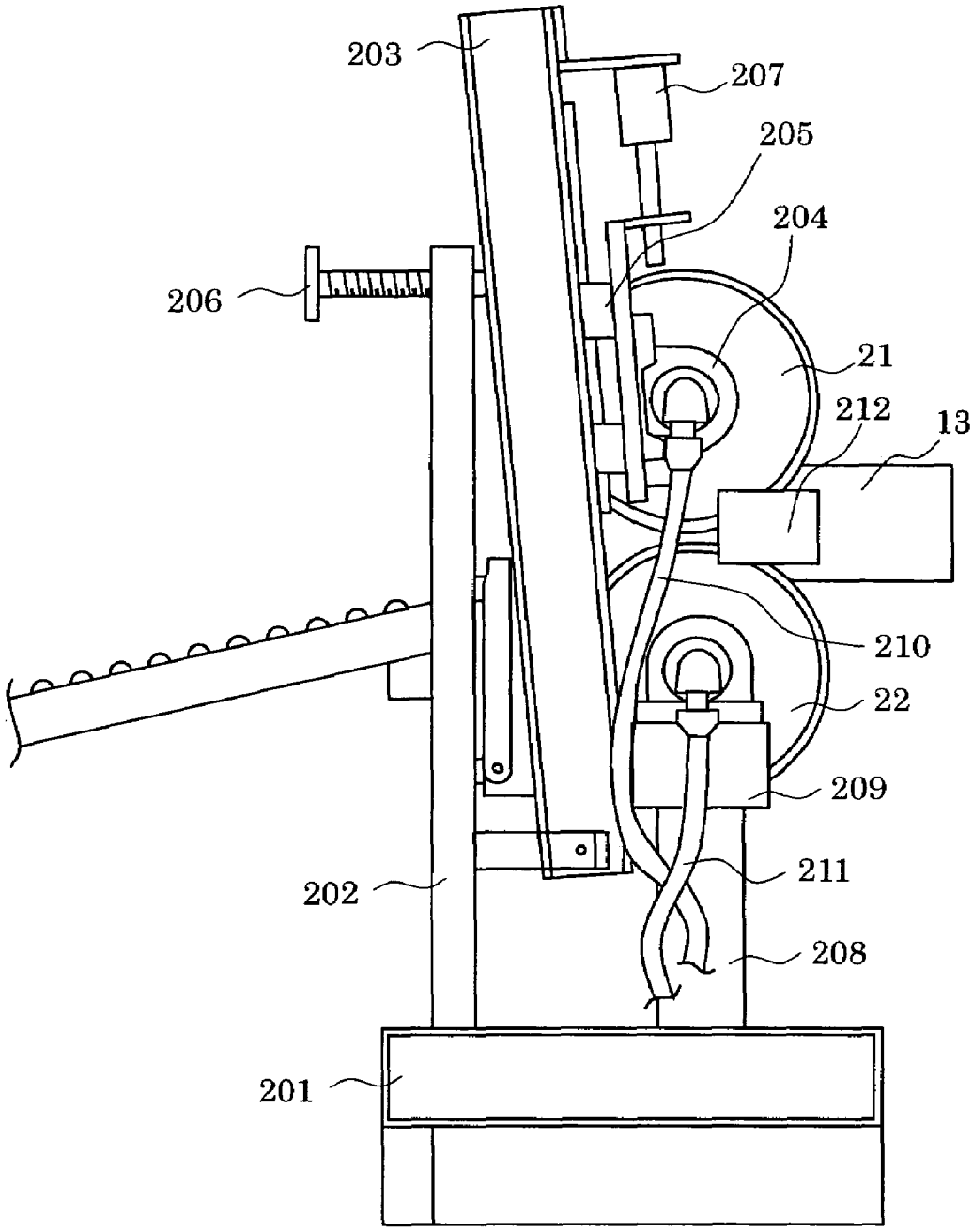
FIG. 4 is a side elevational view of a casting roll section acting as a main portion of FIG. 1.

As shown in FIG. 4, two supporting columns 202, 208 are fixedly disposed on a base table 201. The supporting column 202 has an inclining plate 203 attached thereto so as to incline about an end thereof, and a roll angle α shown in FIG. 1 can be adjusted by turning a screw handle 206. Namely, the inclining plate 203 can be inclined by actuating the screw handle 206, thereby the roll angle α can be changed.

Further, a casing upper roll height adjustment unit 207 is disposed to an upper portion of the inclining plate 203. The height adjustment unit 207 is coupled with a bearing unit 204 for rotatably supporting the casting upper roll 21. The bearing unit 204 can move on the inclining plate 203 through rail units 205.

Accordingly, when the casting upper roll height adjustment unit 207 is actuated, the bearing unit 204 is caused to slide up and down on the inclining plate 203, and thus the gap between the casting upper and lower rolls 21 and 22 is adjusted, thereby a load to be applied to the plate member in casting is determined.

Further, the supporting column 208 rotatably supports the casting lower roll 22 through a bearing unit 209. The casting lower roll 22 is disposed in the vicinity of the molten metal drawing-out port of the molten metal bath 13 and is arranged such that the molten metal stored in the molten metal bath 13 is adhered to the roll surface of the casting lower roll 22 and drawn out from the molten metal bath 13 to the outside by the rotational force of the casting lower roll 22.

Moreover, a pair of side dams 212 are disposed such that they are in sliding contact with both the end surfaces of the casting lower and upper rolls 22 and 21 at the position where the rolls 22 and 21 are located most closely to each other. With this arrangement, the side dams 212 can prevent the leakage of the molten metal supplied between the casting lower and upper rolls 22 and 21 therefrom.

A rotating drive unit (not shown) is coupled with each of the casting upper and lower rolls 21 and 22 and rotated in the direction shown by an arrow in FIG. 1 at a predetermined rotational speed. With the above arrangement, the solidifying surface of the molten metal, which is drawn out to the outside of the molten metal bath 13 by the rotational force of the casting lower roll 22, is pressed downward by the casting upper roll 21, that is, the molten metal is rolled and molded. It is preferable that a load applied at the time be within the range of from 0.01 to 1.0 kN/mm in a unit length in a roll width direction. It is not preferable that the load per the unit length in the roll width direction be smaller than the above range because, in the case, not only it is difficult to continuously form a plate member but also the surface of the produced plate member is coarsened. In contrast, it is also preferable that the load per the unit length in the roll width direction exceed the above range because defects such as exfoliation and the like occur at the center of the plate member after it is molded.

In addition, hoses 210 and 211 are connected to the casting upper and lower rolls 21 and 22, respectively so that a heat medium such as water, oil, or the like is supplied into the rolls therethrough. That is, the surfaces of the respective rolls can be cooled to, maintained at, and heated to a desired temperature (roll surface temperature at which the plate member to be cast can maintain its shape up to the rolling roll section) by adjusting the temperature of the heat medium. With the above arrangement, it is possible to make a plate member the surface of which on the casing lower roll side is solidified and the surface of which on the casing upper roll side is not solidified and to cast a plate member both the surfaces of which are solidified and the central portion of which is not solidified.

The molding upper roll 21 and the casting lower roll 22 can be formed of an iron-based alloy or a copper alloy.

In the arrangement of the casting roll section 20 of FIG. 4, an example that the handle screw 206 is turned as means for adjusting the roll angle α, that is, the angle between the casting upper roll 21 and the casting lower roll 22 is shown. However, a drive mechanism composed of a hydraulic unit can be employed in place of the handle screw 206. Further, an adjustment mechanism composed a combination of a spring member and a bolt/nut unit or a known adjustment mechanism such as a hydraulic unit can be also employed as the casting upper roll height adjustment unit 207 that is a means for adjusting the gap between the casting upper and lower rolls 21 and 22.

(Conveying Section)

The plate member conveying section 30 is a mechanism for conveying the magnesium metal plate member molded in the upstream process to the rolling roll section 40 that is a downstream process. Namely, in the apparatus of the embodiment shown in FIG. 1, a conveying device 31 such as a roller conveyer is interposed between the casting roll section 20 and the rolling roll section 40 to convey the plate member m2 formed in the casting roll section 20 to the rolling roll section 40.

It is preferable that this process be provided with temperature management means for controlling the relatively high temperature of the plate member after it is cast to a temperature suitable to rolling, in addition to that the plate member is simply conveyed in the process. For this purpose, it is preferable to dispose a heating device such as a heater or a cooling device in the vicinity of the conveying device 31 or to assemble the heating or cooling device in the conveying device.

(Rolling Roll Section)

The rolling roll section 40 is for a process for rolling and molding the cast metal plate member conveyed in the upstream process to a thin plate having a predetermined thickness. That is, as seen in FIG. 1 that shows the embodiment, the rolling roll section 40 rolls the plate member m2 and forms a magnesium metal thin plate m3. The rolling roll section 40 is arranged to roll the plate member m2 by applying pressure thereto upward and downward by a pair of rolls 41 and 42 that are in a rotating state. Further, a temperature adjusting mechanism (not shown) is attached to each of the rolling rolls so that a roll temperature can be arbitrarily adjusted.

(Working Section)

The working section 50 is a mechanism for working the thin plate, which has been rolled and molded in the rolling roll section 40 described above, to a required shape, and any molding means, which can be applied to a thin metal sheet, such as a slitter, a long plate winder, a stamping machine, a press, and the like can be applied to the working section 50.

FIG. 1 shows an example that a plate member cutting mechanism is applied as the mechanism of the working section 50. That is, in FIG. 1, the magnesium metal thin plate m3, which has been rolled and formed to the predetermined thickness in the rolling roll section 40, is cut to a predetermined length by a cutting blade 51 on a support table 53 and placed on a thin plate placing table 52.

As described above, a magnesium metal plate-shaped molded body can be manufactured from a magnesium molten metal by the apparatus of the embodiment through a continuous process at a high speed. The most important process in the present invention is a temperature management process for the casting roll section 20. When the temperature in this process is high, a plate member having been cast is liable to be broken in the conveying section because the strength of the plate member is insufficient due to a liquid phase remaining in the metal structure thereof. Further, when the temperature of the casting roll section is low, since the viscosity of the molten metal is high at a molten metal drawing-out port 14, there is a great possibility that the port 14 is clogged and casting becomes impossible. Accordingly, it is important to provide a molten metal rapidly cooling device and process in the process from the molten metal supply section 10 to the casting roll section 20.

In contrast, the plate member having been cast by the casting rolls must have such a degree of strength as to maintain the shape thereof in the subsequent conveying device. However, it is not necessary that the plate member be solidified 100% and it is rather preferable that the plate member be not perfectly solidified because the plate member in this state can be easily rolled in the subsequent rolling process.

(Functions and Advantages of the Manufacturing Apparatus of the Embodiment)

Ordinarily, when light metal such as aluminum and the like is cast and rolled, a cast and rolled plate member is adhered to a roll surface and is unlike to be exfoliated therefrom, thereby the surface of the plate member is liable to become defective. In the apparatus of the above embodiment, a releasing agent composed of powder of carbon and the like is sprayed on the surfaces of the rolls to cause a cast and rolled plate member to be easily exfoliated from the roll surfaces. However, when the releasing gent such as carbon is adhered, carbon remains on the surface of a manufactured plate member and deteriorates the outside appearance of the plate member. In addition to the above, a process for causing the carbon to adhere on the roll surfaces and eliminating the carbon from the surface of the plate member having been cast is necessary, by which workability is deteriorated. Further, the releasing agent inhibits heat transmission through the carbon on the surface of the plate member after it is cast and a cooling speed is reduced thereby, from which a problem arises in that the manufacturing efficiency of a thin plate is lowered.

In the manufacture of the plate member from magnesium by means of the casting and rolling described above, the plate member can be manufactured without the need of the carbon releasing agent. Accordingly, a plate member having excellent surface flatness can be manufactured as well as not only the manufacturing method is excellent in workability but also can reduce manufacturing cost, thereby a product having excellent quality can be manufactured.

Further, the manufacturing apparatus of the embodiment described above can manufacture the plate member at a speed exceeding 5 m/min in contrast with a plate member manufacturing speed of 2 to 5 m/min in conventional casing and rolling of light metal.

[Modification of Molten Metal Supply Section]

In the molten metal supply section of the embodiment shown in FIG. 1, there is explained an example in which employed is the device for supplying the magnesium molten metal from the crucible 11 to the molten metal bath 13 using a molten metal supply trough 12. However, a molten metal supply device having a structure shown in FIGS. 2 and 3 can be used in place of the device having the above structure. The components in FIGS. 2 and 3 that have the same functions as those shown in FIG. 1 are denoted by the same reference numerals, and a detailed description thereof is omitted.

Figure 2:
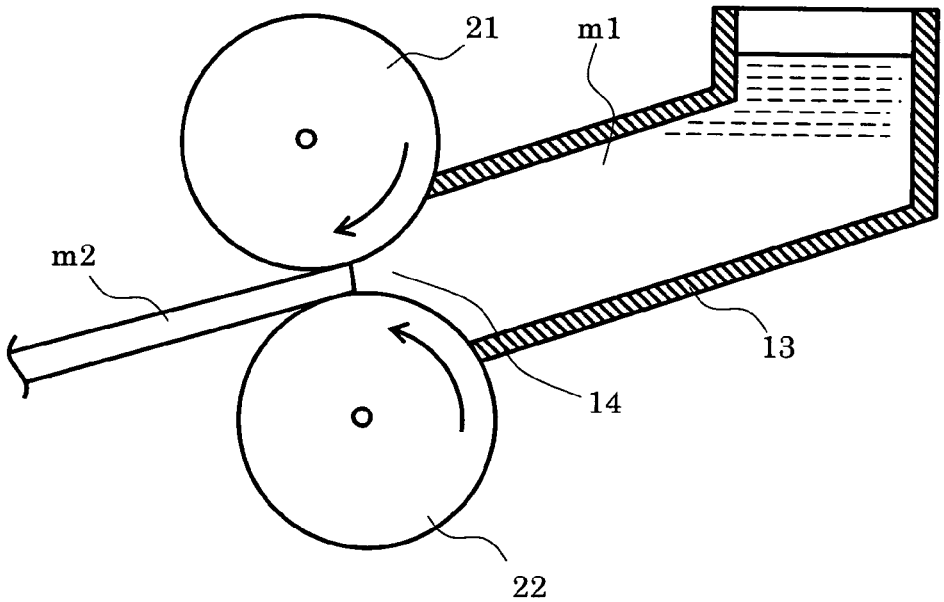
FIG. 2 is a partial schematic sectional view showing another example of a molten metal supply section of the manufacturing apparatus of the present invention.

The molten metal bath 13 shown in FIG. 2 is covered with a lid 16 in the path thereof from a molten metal supply port to a molten metal drawing-out port 14, thereby a temperature drop can prevented therebetween so that a temperature control can be easily executed or is intended to be easily executed. Further, it is possible to control the temperature of the molten metal supplied to a casting roll section 20 by disposing a temperature control device such as a heating device, a cooling device or the like around the molten metal bath 13.

Figure 3:
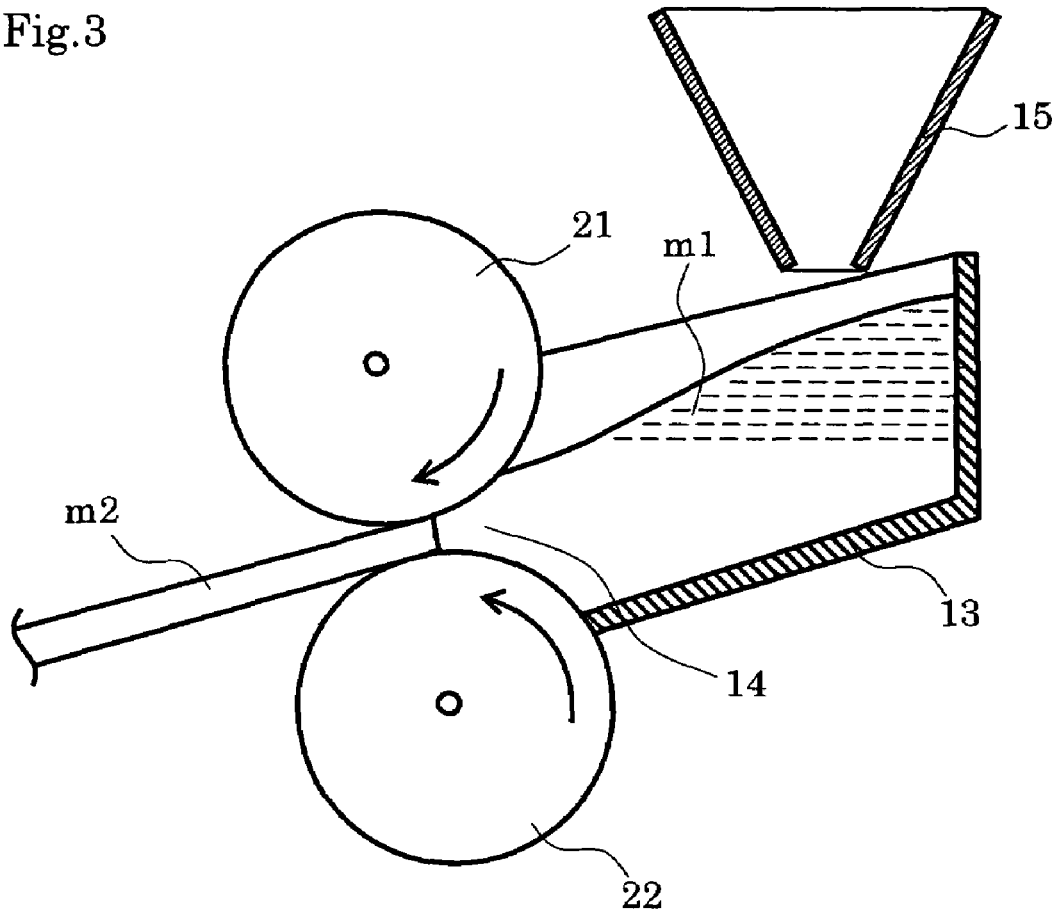
FIG. 3 is a schematic sectional view showing an example using a molten metal supply member in the molten metal supply section of the manufacturing apparatus of the present invention.

When the magnesium molten metal is supplied from the crucible 11 to the molten metal bath 13, it is preferable that the molten metal be introduced into a casting roll section while being rectified. For this purpose, it is preferable to use a funnel-shaped molten metal supply member 15, to pour the molten metal from the crucible 11 into the molten metal supply member 15 once, and to move the molten metal into the molten metal bath 13 while rectifying it as shown in FIG. 3.

[Modification of Casting Rolls]

Figure 5:
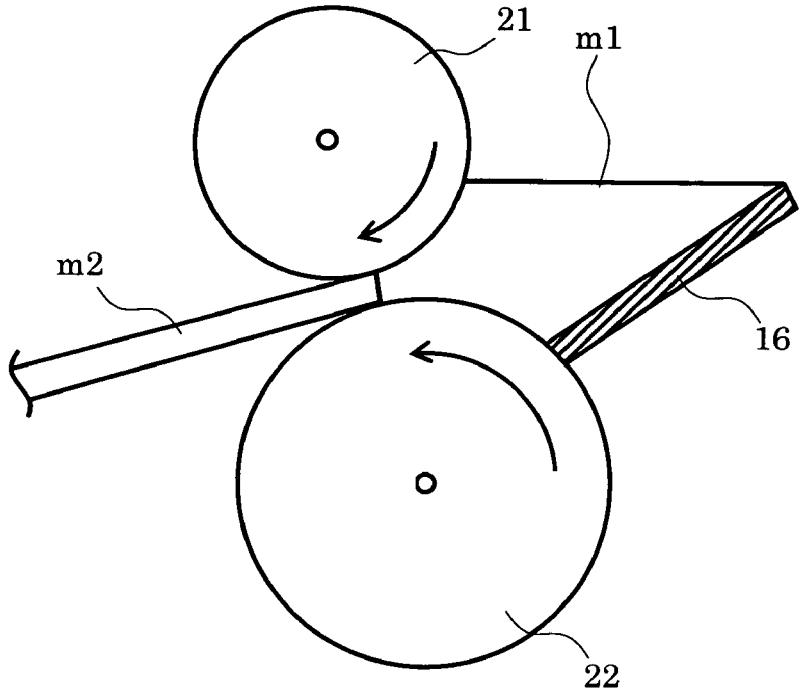
FIG. 5 is a conceptual view of a casting roll section as another embodiment of the present invention.

Although an example, in which the two rolls having the same diameter are used as the casting rolls, is shown in the above embodiment, it is not always necessary that the two rolls have the same diameter. An example of the case is shown in FIG. 5. FIG. 5 is a schematic view of a casting roll portion in the modification. In FIG. 5, reference numeral 21 denotes a casing upper roll, and reference numeral 22 denotes a casting lower roll. In these rolls, the diameter of the casting upper roll 21 is smaller than that of the casting lower roll 22. In the structure of the casting roll portion, although the molten metal m1 is supplied between the casting lower roll 22 and the casting upper roll 21, it can be stably supplied therebetween by disposing a dam plate 16 in contact with the casting lower roll 22. In the mechanism shown in FIG. 5, it is preferable to provide side dams (not shown) at both the ends of the casting upper and lower rolls 21 and 22 as shown in FIG. 4.

[Modification of Conveying Device]

Figure 6:
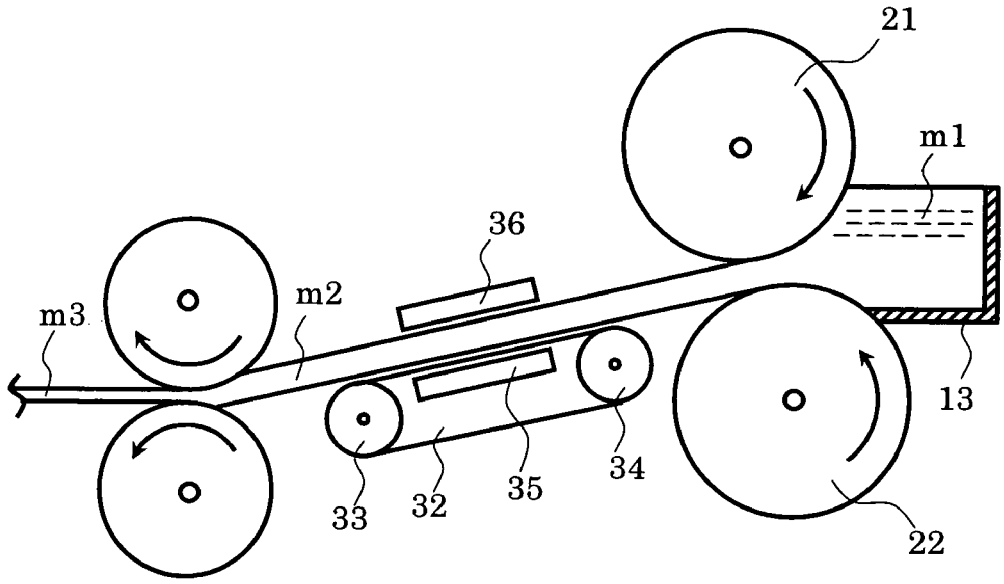
FIG. 6 is a partial conceptual view showing another example of a conveying section of the manufacturing apparatus of the present invention.

Although the embodiment of FIG. 1 shows an example that the roller conveyer is used as the conveying device 31, a conveying device 32 such as a conveyer belt can be employed in place of the roller conveyer. That is, as shown in FIG. 6, the belt 32 is stretched between a pair of rollers 33, 34 driven by a rotational drive unit (not shown), and a plate member is placed thereon and conveyed. According to the above device, the belt conveyer can more smoothly convey the plate member than the roller conveyer, and thus a possibility that the plate member is broken in a conveying process can be reduced. Although FIG. 6 shows an example that the belt conveyer 32 is disposed under the lower surface of the plate member m2 to be conveyed, belt conveyers may be disposed on the lower and upper surfaces of the plate member m2 so that the plate member is sandwiched therebetween. According to the above arrangement, the plate member m2 can be conveyed with the more reduced possibility of breakage of it. Furthermore, since the heat radiation is shut off by the belt conveyers, there is also an advantage that temperature can be easily managed.

Moreover, in FIG. 6, reference numerals 35 and 36 denote temperature control devices such as heating devices or cooling devices which permit the temperature of the plate member m2 in a rolling roll section 40 to be adjusted accurately by controlling the temperature of the plate member m2, whereby a thin plate having good quality can be manufactured.

[Another Modification of the Manufacturing Apparatus]

Although the apparatus of the above embodiment shows an example that magnesium is cast and rolled in the continuous process, it is also possible to wind the plate member having been cast around a roll once without continuously conveying it to the rolling process as a downstream process and to reheat and to roll it. According to the above means, a thin sheet can be manufactured more flexibly in correspondence to the production adjustment and the like thereof.

[Manufacturing Method]

A magnesium metal thin plate will be manufactured using the magnesium metal thin plate manufacturing apparatus 1 having the arrangement shown in FIG. 1 as described below.

As a preparation process, the roll angle $\alpha$ is previously set to a predetermined angle by adjusting the handle screw 206. Further, the gap between the casting upper and lower rolls 21 and 22 (thickness of the plate member to be rolled) is set to a predetermined distance (interval) by adjusting the casting upper roll height adjustment unit 207. Then, the roll surface temperature of the casting roll section 20 is set to a predetermined temperature in accordance with the above set values.

Next, as a manufacturing process, first, the magnesium metal melted in the crucible 11 is prepared as the molten metal m0. Then, the molten metal m0 in the crucible 11 is caused to flow on the molten metal supply trough 12, rectified, cooled to a predetermined temperature at which it can be cast, and then introduced into the molten metal bath 3 as the molten metal m1.

The molten metal m1 supplied into the molten metal bath 3 up to a height h2, and then discharged to the outside of the molten metal bath 13 while being caused to come into pressure contact with the casting upper and lower rolls 21 and 22 that are being rotated to thereby molded as the plate member m2. At the time, the temperature of the plate member m2 is adjusted to a rolling possible temperature by adjusting the surface temperature of at least the pair of rolls.

The plate member m2 is conveyed to the rolling roll section 40 by the roller conveyer 31, rolled by being applied with upward and downward pressure by the rolling upper and lower rolls 41 and 42, and molded as the magnesium metal thin plate m3.

As described above, in the embodiment according to the present invention, since the magnesium metal plate member, which has been molded in the casting process (process executed by the casting roll section 20), is molded and drawn out in a rolling possible temperature state, it is possible to subject the plate member to warm rolling processing, thereby the magnesium metal thin plate can be molded.

Further, since the rolling possible temperature can be set in accordance with the thickness of the plate member, thin plates having various thicknesses can be molded by the manufacturing apparatus 1.

Moreover, since it is not necessary to generate heat energy again in the rolling process (neither a device nor a process is necessary for this purpose), the cost of the apparatus can be reduced and productivity can be improved.

[Modification]

Figure 7:
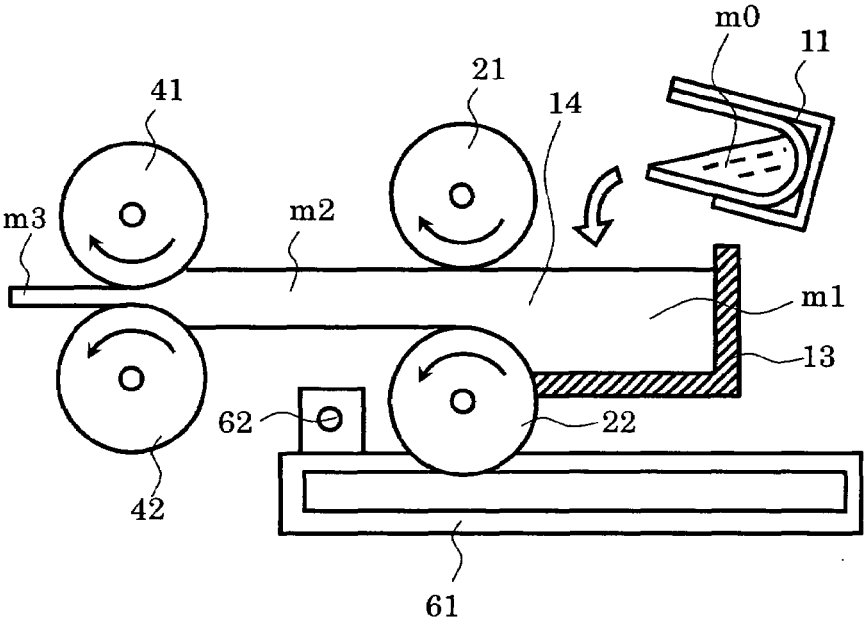
FIG. 7 is a conceptual view of a magnesium metal thin plate manufacturing apparatus showing another mode of the casting roll section.

Next, a modification of the casting roll section 20 described above will be explained based on FIG. 7. Since the other arrangement of the casting roll section 20 is the same as that shown in FIG. 1, the same components as those of FIG. 1 are denoted by the same reference numerals and the description thereof is omitted.

The casting roll section 20 has a casting upper roll 21, a casting lower roll 22, and a geared motor 62 disposed on a base table 61. The casting upper roll 21 is rotatably disposed on the base table 61.

Further, the casting lower roll 22 is disposed at a drawing-out port 14 of a molten metal bath 13, and the casting lower roll 22 and the molten metal bath 13 are driven by the geared motor 62 so as to move on the base table 61 in a horizontal direction. In addition, each of the casting upper and lower rolls 21 and 22 is provided with a temperature adjustment function (not shown).

In the casting roll section 20, the casting lower roll 22 and the molten metal bath 13 are moved to arbitrary positions on the base table 61 by driving the geared motor 62 as a preparation process of the manufacture of a magnesium metal thin plate. That is, the gap between the casting lower and upper rolls 22 and 21 can be changed as well as the angle between the casting lower and upper rolls 22 and 21, i.e. the roller angle $\alpha$ can be changed by moving the casting lower roll 22 (and the molten metal bath 13).

EXAMPLES

Example 1

A magnesium alloy (composition: AM 60) was melted at 640° C. using the apparatus shown in FIG. 1 and cast using the pair of casting upper and lower rolls 21 and 22 each having a roll diameter of 300 mm and composed of a copper alloy with a gap therebetween set to 2 mm at a roll peripheral speed of 40 m/min with a load per unit length in a roll width direction of 0.6 kN/mm. The temperature of the molten metal was 612° C. when it was introduced to the casting rolls. A plate member having been cast was conveyed using the conveyer belt conveying device and rolled by the rolling rolls, thereby a magnesium alloy plate member having a thickness of 2.5 mm was obtained. The plate member had a flat and smooth surface without ripple mark, interlayer exfoliation, center line segregation and surface roughness.

Comparative Example 1

For comparison, casting and rolling were executed by the same method as that of Example 1 except that the temperature of a molten metal supplied to the casting rolls was set to 660° C. As a result, it was impossible to continuously execute the operation because a plate member was often broken.

INDUSTRIAL APPLICABILITY

As apparent from the above explanation, there can be provided the magnesium metal thin plate manufacturing method and manufacturing apparatus that can effectively manufacture a magnesium metal thin plate by plastic working without requiring a heat energy generation process again in rolling.

The invention claimed is:

1. A magnesium metal thin plate manufacturing method comprising at least:

a casting process of supplying a magnesium molten metal to at least a pair of first rolls and casting the molten metal to a plate member having a predetermined thickness; and a rolling process of rolling the cast plate member by applying pressure thereto by means of at least a pair of second rolls to manufacture a magnesium metal thin plate having a predetermined thickness, wherein the magnesium molten metal, just before entering the casting process, is within a temperature range from a temperature at which the ratio of a solid phase occupying the magnesium metal is 10 wt % or less to a temperature 40° C. higher than the melting temperature of the magnesium metal.

2. The magnesium metal thin plate manufacturing method according to claim 1, wherein a magnesium metal solid/liquid mixture is rapidly cooled at a speed of $5\times10^{2\circ}$ C. per second or more before or after the casting process.

* * * * *